US009616702B2

(12) United States Patent
Unser

(10) Patent No.: US 9,616,702 B2
(45) Date of Patent: Apr. 11, 2017

(54) DECORATIVE LAWN UTILITY STRUCTURE COVER AND METHOD

(71) Applicant: Matthew C. Unser, Durand, WI (US)

(72) Inventor: Matthew C. Unser, Durand, WI (US)

( * ) Notice: Subject to any disclaimer, the term of this patent is extended or adjusted under 35 U.S.C. 154(b) by 225 days.

(21) Appl. No.: 14/632,916

(22) Filed: Feb. 26, 2015

(65) Prior Publication Data

US 2015/0238037 A1 Aug. 27, 2015

Related U.S. Application Data

(60) Provisional application No. 61/945,475, filed on Feb. 27, 2014.

(51) Int. Cl.

| | |
|---|---|
| ***B44F 7/00*** | (2006.01) |
| ***B44F 9/04*** | (2006.01) |
| ***B44C 5/00*** | (2006.01) |

(52) U.S. Cl.

CPC ..... *B44F 9/04* (2013.01); *B44C 5/00* (2013.01); *Y10T 29/49826* (2015.01); *Y10T 428/13* (2015.01)

(58) Field of Classification Search

CPC ..... Y10T 403/64; Y10T 403/642; B44F 9/00; B44F 9/04; B44C 5/00; B44C 5/06; F16L 23/04; F16L 23/08; F16L 23/12

USPC ..... 52/3, 4, 103, 247, 248; 285/367, 410, 285/411; 248/98, 147, 205.1, 218.4, 248/227.3, 230.1, 230.8, 230.9, 689, 907, 248/915; 428/15, 18, 919

See application file for complete search history.

(56) References Cited

U.S. PATENT DOCUMENTS

| | | | | |
|---|---|---|---|---|
| 2,992,503 | A * | 7/1961 | Webb | A01M 31/00 135/901 |
| 4,021,131 | A * | 5/1977 | Bakken | E04H 5/02 135/87 |
| D312,802 | S | 12/1990 | Bedard | |
| 5,685,343 | A | 11/1997 | Smith | |
| 5,782,584 | A | 7/1998 | Arthur | |
| 6,131,654 | A | 10/2000 | Holscher | |
| 6,248,411 | B1 * | 6/2001 | Warfel | B44C 3/042 428/132 |
| 6,311,427 | B1 * | 11/2001 | McNally | A01G 13/04 47/29.3 |
| D635,318 | S * | 3/2011 | Zwade | D34/4 |
| D739,091 | S * | 9/2015 | Banks | D30/121 |

(Continued)

*Primary Examiner* — Robert Canfield

(74) *Attorney, Agent, or Firm* — Global Intellectual Property Agency, LLC; Daniel Boudwin

(57) ABSTRACT

A decorative cover for a lawn utility structure is provided. The cover secures to the structure using an elongated perimeter band, which is secured therearound and provides upstanding tabs to fasten a decorative cover over the lawn structure. The tabs support fasteners that secure the cover, while the cover takes the form of a decorative landscape feature such as a bird bath, water well, faux rock, or the like. The cover may support functional items such as birdbaths or the like, or alternately include an open interior that supports access to the underlying structure while the cover is affixed thereover. An upper portion of the cover is removable to expose a hollow interior portion, which affords access to the fasteners extending through the tabs and the cover when securing or removing the cover for access to the underlying lawn structure.

9 Claims, 7 Drawing Sheets

(56) References Cited

U.S. PATENT DOCUMENTS

| | | | | |
|---|---|---|---|---|
| 2002/0150700 | A1* | 10/2002 | Tennie | B44C 5/00<br>428/27 |
| 2012/0298680 | A1 | 11/2012 | Smith | |
| 2013/0164469 | A1* | 6/2013 | Artmann | A01M 31/025<br>428/35.2 |

* cited by examiner

DECORATIVE LAWN UTILITY STRUCTURE COVER AND METHOD

CROSS REFERENCE TO RELATED APPLICATION

This application claims the benefit of U.S. Provisional Application No. 61/945,475 filed on Feb. 27, 2014. The above identified patent application is herein incorporated by reference in its entirety to provide continuity of disclosure.

BACKGROUND OF THE INVENTION

Field of the Invention

The present invention relates generally to lawn utility structures and to decorative assemblies therefore. More specifically, the present invention relates to a lawn structure cover system that can be used to shroud otherwise unsightly lawn utility structures and other outdoor system access points. The system contemplates various decorative and functional assemblies over outdoor lawn structures, thereby improving the aesthetics of the landscape and covering man-made structures therein.

Many residences and commercial businesses have local, below ground systems for various plumbing and wastewater treatment functions. Common examples include water well for access to potable water and septic tanks for local treatment of waste. These systems generally include an above ground access location in which to either retrieve or to inspect and treat the below-ground system. The above ground portion of the well or tank is critical for maintaining the system and for continued use thereof, but its presence can detract from the aesthetic appeal of the yard and the area.

Most above ground lawn structures and access points include a section of exposed pipe or a concrete portion that projects above the ground, which is visible when viewing the landscape. For those that value an aesthetically pleasing outdoor appearance and natural landscaping, the visual presence of the lawn structure can be unsightly and detract from the rest of the property. What is needed therefore is a means of hiding the lawn structure using a decorative assembly that can cover the same and hide its presence.

The present invention provides such a solution, whereby a decorative cover is disposed over an exposed lawn structure such as a septic tank lid or pipe that extends above ground. The cover provides a functional cover with ornamental features that shrouds the exposed lawn structure and can be removed when access is desired. The cover secures to the lawn structure using a perimeter band that is positioned around the exterior of the lawn structure. The band includes upstanding tabs with fastener locations, whereby the tabs are used to secure the band to the interior of the cover using fasteners through the tabs and into the cover. The cover is formed into a shape that is decorative and ornamentally pleasing. Contemplated shapes include a decorative water well housing, a faux rock, or a bird feeder, which is secured over the exposed pipe and removable therefrom without disassembling the cover during the process. A portion of the cover is removable such that the hollow interior is accessible from the top thereof. This allows the user to obtain access to the fastener locations and the perimeter ring when securing or removing the cover to the lawn structure.

SUMMARY OF THE INVENTION

The following summary is intended solely for the benefit of the reader and is not intended to be limiting in any way.

The present invention provides a cover system for a lawn utility structure that can be utilized for improving the aesthetics of a yard and for shrouding an exposed utility pipe or septic tank lid from the landscape using a decorative and functional cover securable thereto.

It is therefore an object of the present invention to provide a new and improved cover assembly for yard aesthetics that has all of the advantages of the prior art and none of the disadvantages.

It is another object of the present invention to provide a cover assembly that secures over an exposed lawn structure and provides a decorative yet functional cover thereover, whereby the lawn structure is no longer visible and is covered with a more eye-pleasing structure.

Another object of the present invention is to provide a cover assembly that secures to a lawn structure using a perimeter band and fasteners, whereby the fasteners secure to the interior of the cover structure that is positioned over the lawn structure.

Yet another object of the present invention is to provide a cover assembly that can be supported over a lawn structure for long periods of time, and thereafter removed by unfastening the assembly when access is needed to the utility system therebelow.

Another object of the present invention is to provide a cover method that contemplates a cover assembly having decorative landscape appeal that includes a hollow interior configured to receive an exposed lawn structure therein, whereby the cover is secured using a perimeter band affixed to the exterior of the lawn structure.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
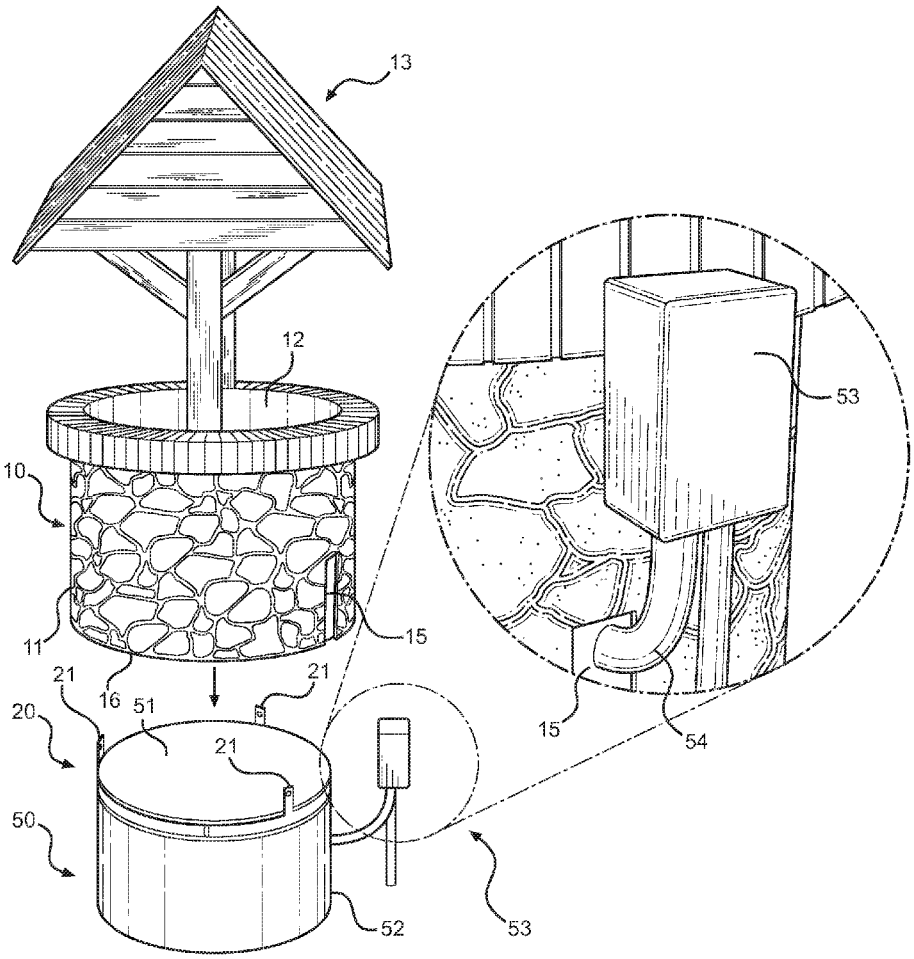
FIG. 1 shows an exploded view of the decorative cover and the attachment system disposed on the upstanding lawn structure to be covered, along with a close-up view of a typical utility meter or access point, and the clearance provided therefor by the cover.

Reference is made herein to the attached drawings. Like reference numerals are used throughout the drawings to depict like or similar elements of the lawn utility structure cover of the present invention. For the purposes of presenting a brief and clear description of the present invention, the preferred embodiment will be discussed as used for covering a lawn utility structure with a decorative cover, whereby the lawn structure is shrouded and can be operably accessed when necessary by removal of the upper portion of the decorative cover or by complete removal of the cover in its entirety. The figures are intended for representative purposes only and should not be considered to be limiting in any respect.

Referring now to FIG. 1, there is shown a view of the cover assembly 10 of the present invention being positioned onto an exposed lawn utility structure 50. The present invention comprises a cover assembly 10 that includes a substantially hollow base 11 and a decorative exterior that forms a specific shape, structure, or design that is appealing to the eye and blends into the existing landscape. Examples of various cover designs are disclosed herein. The various designs are examples of what the inventor considers more appealing to the eye over an existing utility structure 50 typically found on a property. The goal of the present invention is to provide both a cover structure and a method of covering utility structures using an attachment scheme and a decorative cover assembly.

The cover assembly 10 shown in FIG. 1 is that of a bird bath or water well structure, whereby the lower portion 11 is substantially rounded and has a hollow interior 12 and an open lower surface 16. Extending above the lower portion 11 is a gabled roof structure 13. Along the sidewalls of the lower portion 11 is an elongated slot 15 that provides clearance for utility systems such as meters, electrical connections, electrical boxes, or the like extending from the underlying utility structure 50. Typical utility systems include a box 53 and one or more conduits 54 that extend from the sides of the utility structure 50. However, it is not desired to limit the exact system extending therefrom, but rather to disclose a clearance channel 15 suitable for providing access to the utility system when the cover assembly 10 is positioned over the utility structure 50.

The cover 10 provides a decorative way to conceal the visible portions of lawn utility structures 50. Typical lawn utility structures 10 include septic tank access ports, ventilation pipes, well pipes, electrical boxes, gas and electrical pipe access locations, and the like. These lawn structures are generally unattractive items that are positioned within an otherwise serene landscape. The cover assembly 10 provides an improved presentation in the form of an aesthetically pleasing lawn structure disposed over the utility structure location.

Typical lawn utility structures include a protruding member that extends above the lawn surface and has upstanding sidewalls. The cover 10 secures to the structure 50 using an elongated perimeter ring 20, which is a band of material extending around the outer perimeter of the lawn structure 10 and securing thereto such that the ring 20 is statically affixed to the exterior of the structure when deployed. The ring 20 includes a plurality of upstanding fastener tabs 21 that support a fastener therethrough. The fasteners extend through the tabs 21 and into the cover 10 once positioned thereover, whereby the fasteners engage the cover to lock the ring 20 and the cover 10 together. The friction between the ring 20 and the utility structure 50, and the fasteners between the cover 10 and the ring 20, stabilize the cover 10 and prevent relative movement. The ring 20 is tensioned around the utility structure 50 and compresses the same, thereby establishing the frictional connection that requires no additional fasteners between the ring 20 and the lawn utility structure 50.

Figure 2:
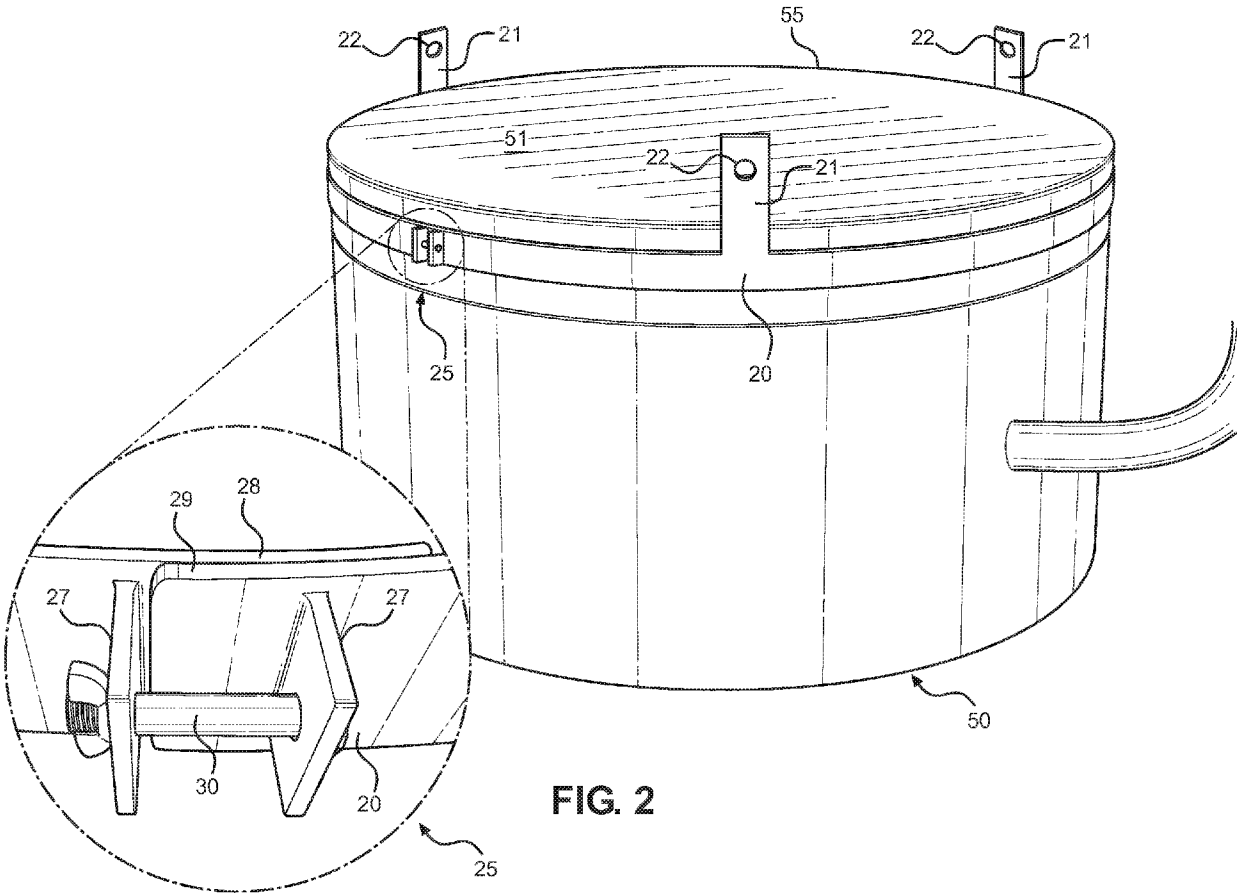
FIG. 2 shows a typical lawn utility structure to be covered by the present invention, along with the cover attachment system.

Referring now to FIG. 2, there is shown a view of an example lawn utility structure 50 upon which the attachment ring 20 is disposed. The attachment ring 20 comprises an elongated band of material that extends around the outer perimeter of the lawn structure 50 and is tensioned therearound. The ring 20 includes a first end 28 and a second end 29 that are fastened together to drawn the ends together and thus draw the ring 20 against the outer surface of the structure 50. A fastener flange 27 is disposed at each end 28, 29 that support a fastener 30 therebetween. The flanges 27 extend outward from the ring 20 and are substantially perpendicular thereto. The fastener 30 is positioned within fastener holes in each flange 27 and the fastener is drawn together using its threaded body. The flanges 27 in turn tension the ring 20 as the flanges 27 are drawn together by the ring fastener 30, compressing the structure 50 within the interior of the ring as its interior area is reduced. The flanges 27, ring ends, and the ring fastener are collectively denoted as the ring attachment assembly 25.

Along the length of the ring 20 are a plurality of upstanding tabs 21 that extend substantially perpendicularly to the ring and are configured to extend vertically when the ring is disposed around the outer periphery of an upstanding utility structure 50. The ring 20 is positioned around the structure 50 below its upper surface 51 and below the upper edge 55 thereof. The upstanding tabs 21 have a defined length such that when the ring 20 is secured adjacently to the upper edge 55 of the structure 50, the tabs 21 extend above the upper surface 51 of the structure. This elevated position provides access to both the interior and exterior sides of the tabs 21 such that a fastener can be inserted through a fastener location 22 in each tab. Each fastener is inserted from the interior surface of the tabs and directed outward and into the cover assembly once the cover assembly has been positioned over the structure 50 and outboard of the ring 20 relative to the structure 50.

The cover 10 includes a hollow interior that is configured to receive the lawn structure 50 therein. To secure the fasteners to the upstanding tabs 21 once the perimeter ring 20 is secured to the lawn structure 50, the upper portion of the cover is open to afford access. The upper portion of the cover is operably openable or is permanently open and may be covered with a cover upper surface. The removable upper portion of the cover facilitates installation and removable of the cover, and also affords access to the underlying lawn structure when necessary without removing the entire cover assembly.

Figure 3:
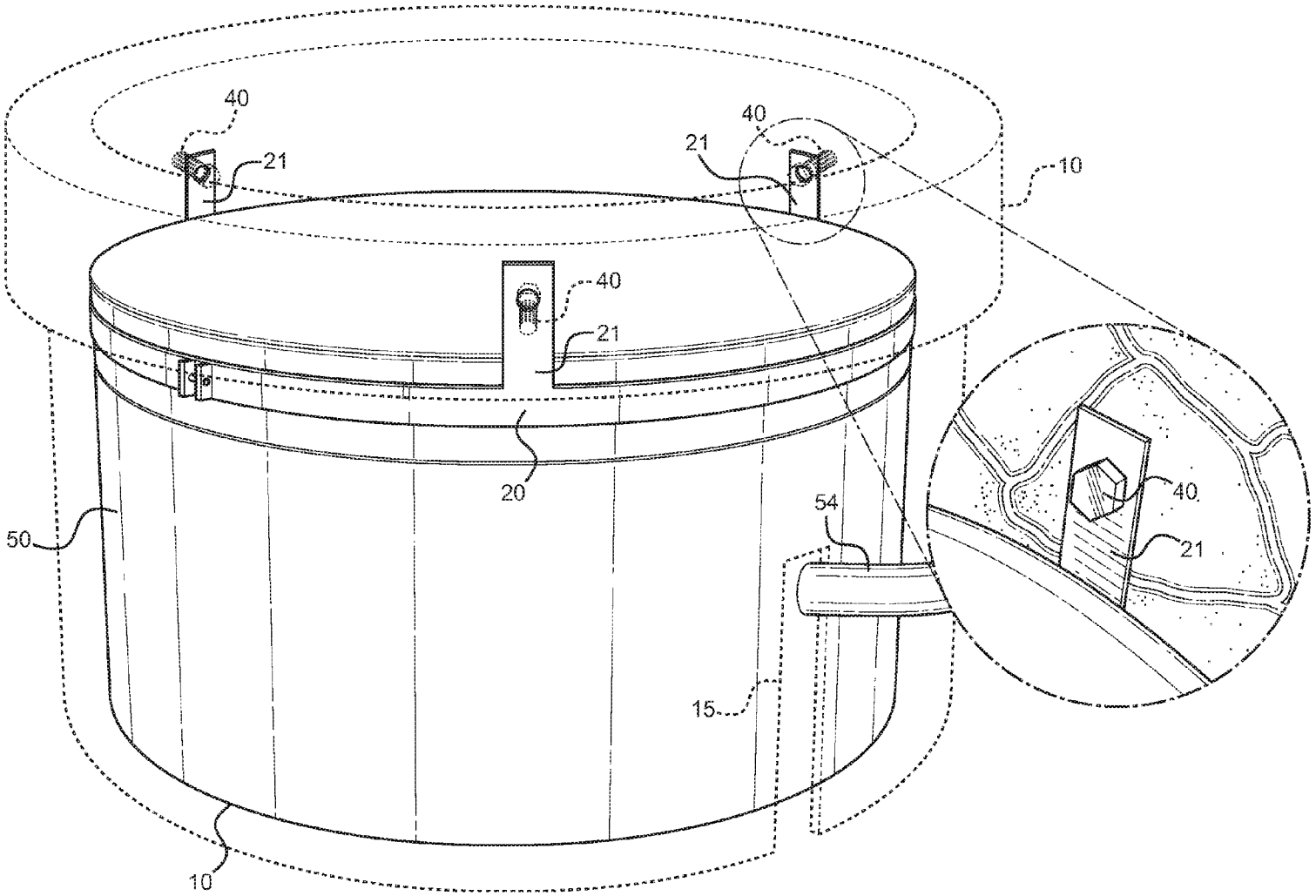
FIG. 3 shows another view of the attachment system in connection with the cover.

Referring now to FIG. 3, there is shown a view of the lawn structure 50 being covered and fastened thereto. The cover 10 is one that includes a lower portion having a defined shape such that the exterior provides a decorative outer appearance while the interior of the lower portion provides clearance for the protruding lawn structure 50 to be supported therein. Additional clearance is provided along the sides of the lawn structure 50 where necessary to provide a channel 15 or opening for pipes, cables, or other equipment 54 extending from the sides of the structure 50.

To secure the cover 10 to the structure 50, the ring 20 is positioned therearound and tensioned against the sidewalls of the lawn structure 50. The upstanding tabs 21 of the ring provide fastener locations through which fasteners 40 are extended through the tabs 21 and into the cover 10 to secure the ring 20 and the cover 10 together along the exterior of the structure 50. The ring 20 is tensioned around the lawn structure sufficiently that the cover 10, once fastened to the ring, will not readily be removable by pulling upwards on the cover or otherwise disturbing it. Tension in the ring 20 applies pressure to the outer surface of the lawn structure and creates a frictional engagement between the ring 20 and the lawn structure 50. This prevents the cover from being removed during high winds or weather, and requires the fasteners of the ring 20 to be removed in order to remove the cover 10.

Figure 4:
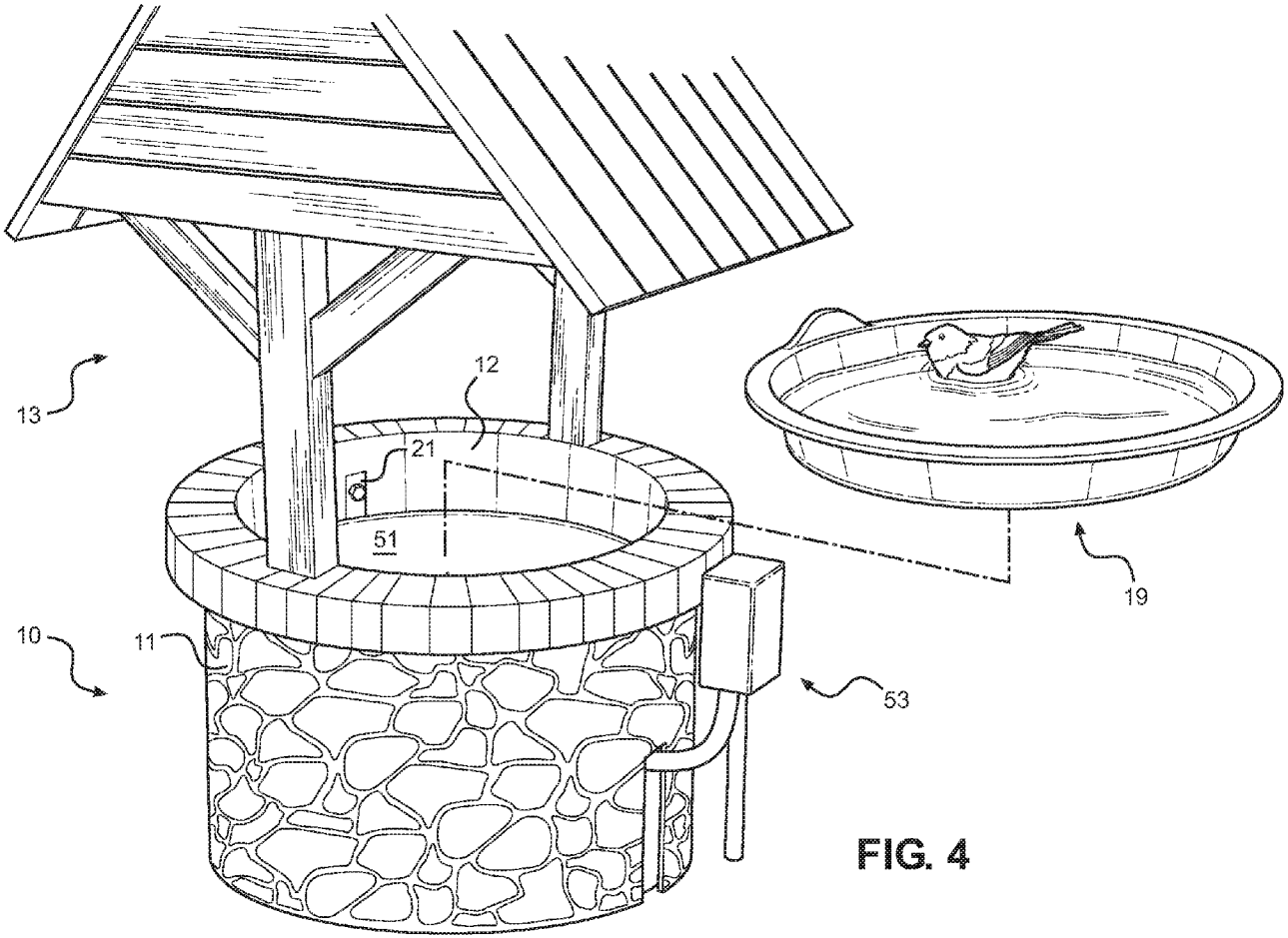
FIG. 4 shows an embodiment of the present invention in which the cover is that of a bird bath structure.

Referring now to FIG. 4, there is shown an embodiment of the cover after it has been installed over the exposed yard structure. In this embodiment, the cover 10 comprises a lower portion 11 that surround the structure and an upper portion 13 that provides a decorative roof thereover. Within the lower portions 11 is a hollow interior 12 that receives the lawn structure therein. Access to the upper surface 51 of the lawn structure is facilitated by a removable upper surface 19. The upper surface secures over the exposed upper of the cover 10 and closes off the hollow interior portion 12. The upper surface 19 may be an upper portion of the cover, or alternatively may be a surface that is positionable over the hollow interior 12 as presented in FIG. 4. In the embodiment of FIG. 4, there upper surface 19 is a bird bath assembly that is placeable over the upper portion of the hollow interior 12. When access to the fastener tabs 21 or the underlying lawn structure is desired, the upper surface 19 is removable. This allows for ease of installation, removable, and intermediate maintenance of the lawn utility being covered.

Overall, the present invention comprises a cover for otherwise unsightly lawn structures within a landscape, which may be difficult to remove or are often required systems for an adjacent residence or utility system. These structures include septic tanks lids, cable boxes, vents, transformers and other electrical boxes, and the like that serve a utilitarian purposes but are not otherwise naturally occurring in the scenery. The upstanding or enlarged lawn structures generally extend above the law or along a property and detract from the aesthetics thereof. The present invention is designed to provide a shroud thereover that secures to the structure and can support both decorative shapes (faux wells, barns and building structures, faux rocks, etc.) and functional elements (i.e. bird bath, flower pots, faux tree stumps, bird feeders, etc.).

Figure 5B:
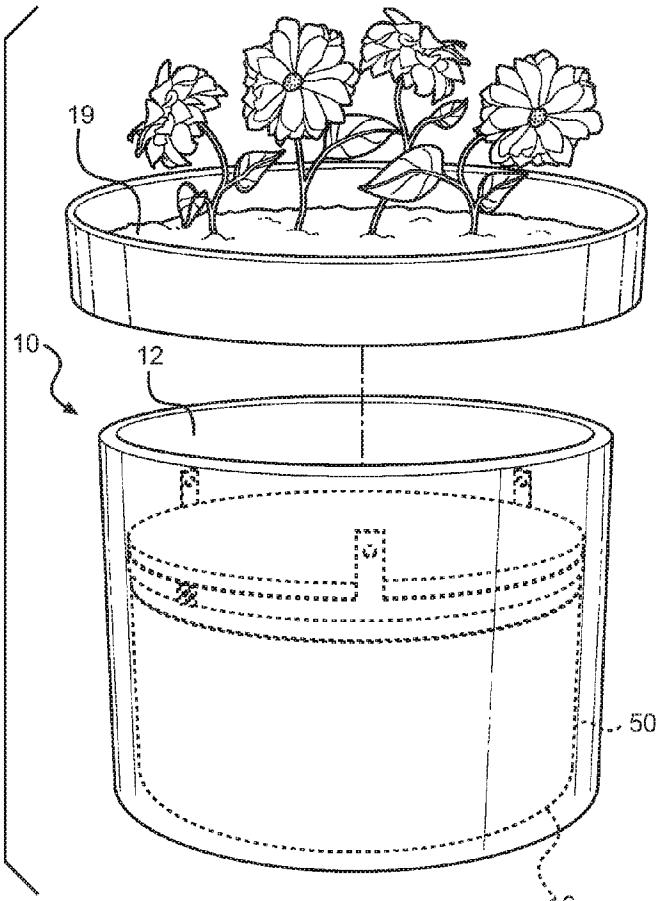
FIG. 5B shows another embodiment of the cover.
Figure 5A:
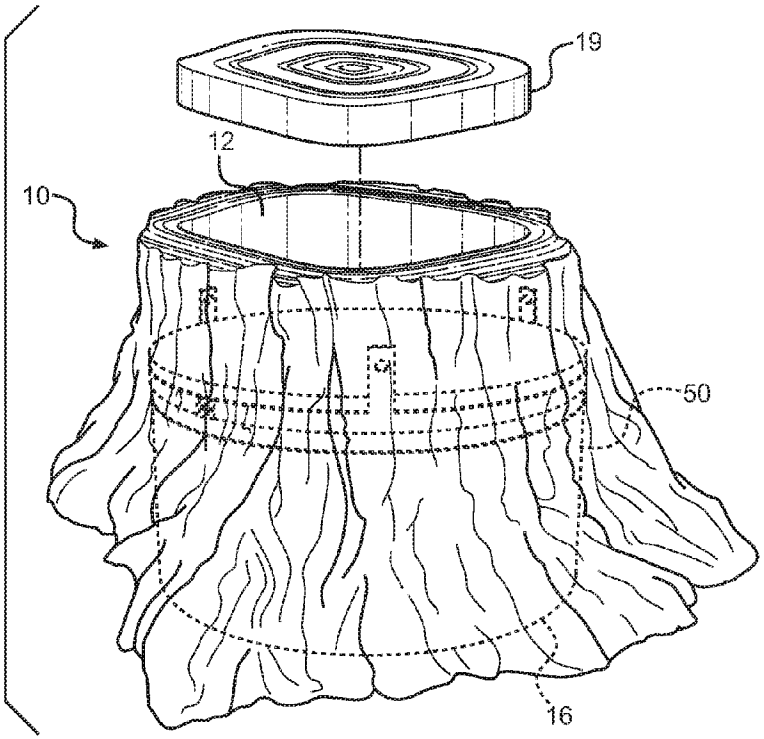
FIG. 5A shows an embodiment of the cover.

FIGS. 5A through 5E show various embodiments of the cover design, including a tree stump embodiment, a vegetable or flower planter embodiment, a faux rock embodiment, a miniature farm silo embodiment, and a miniature barn embodiment. The tree stump is shown in FIG. 5A, the planter in 5B, the rock in 5C, the silo in 5D, and the barn in 5E. Each embodiment comprises a unique cover outer shape and outer surface profile, whereby the shape and outer surface may have texture or a specific design to mimic a desired article within the landscape. The covers are designed to provide the look of an article that is typically found in a yard, which covers a man-made lawn structure such as a utility cover or upstanding pipe or well. Each of the covers 10 includes a hollow interior 12 sized to receive the law structure therein and an open lower surface 16. Each is placed over the lawn structure and fastened thereto using the fasteners and the ring connection around the structure.

Figure 5D:
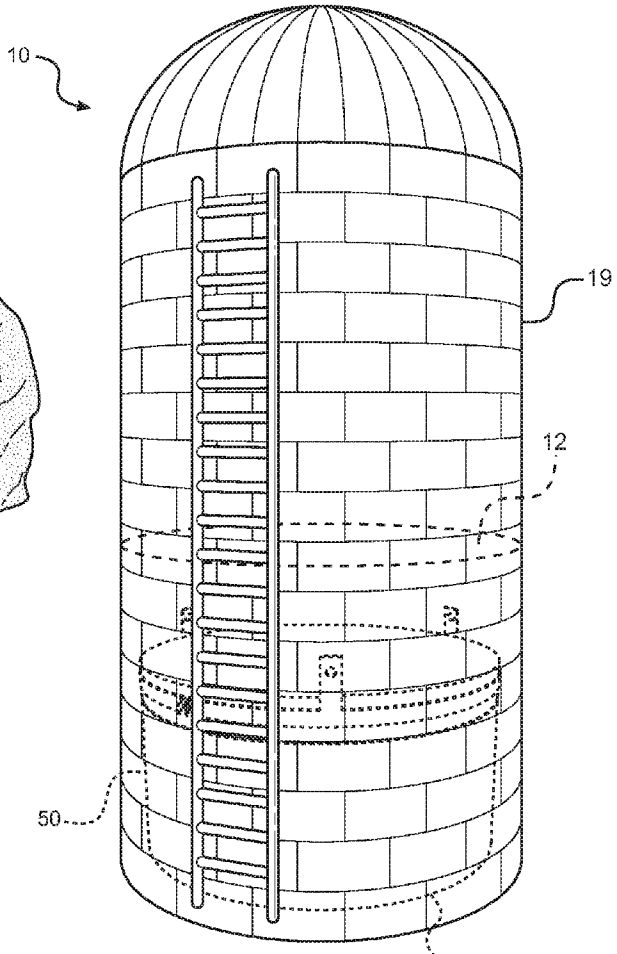
FIG. 5D shows another embodiment of the cover.
Figure 5C:
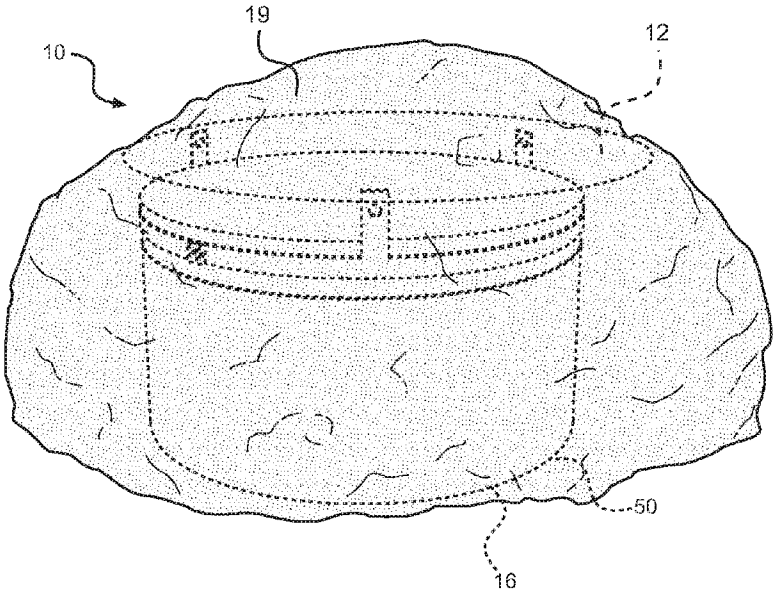
FIG. 5C shows another embodiment of the cover.
Figure 5E:
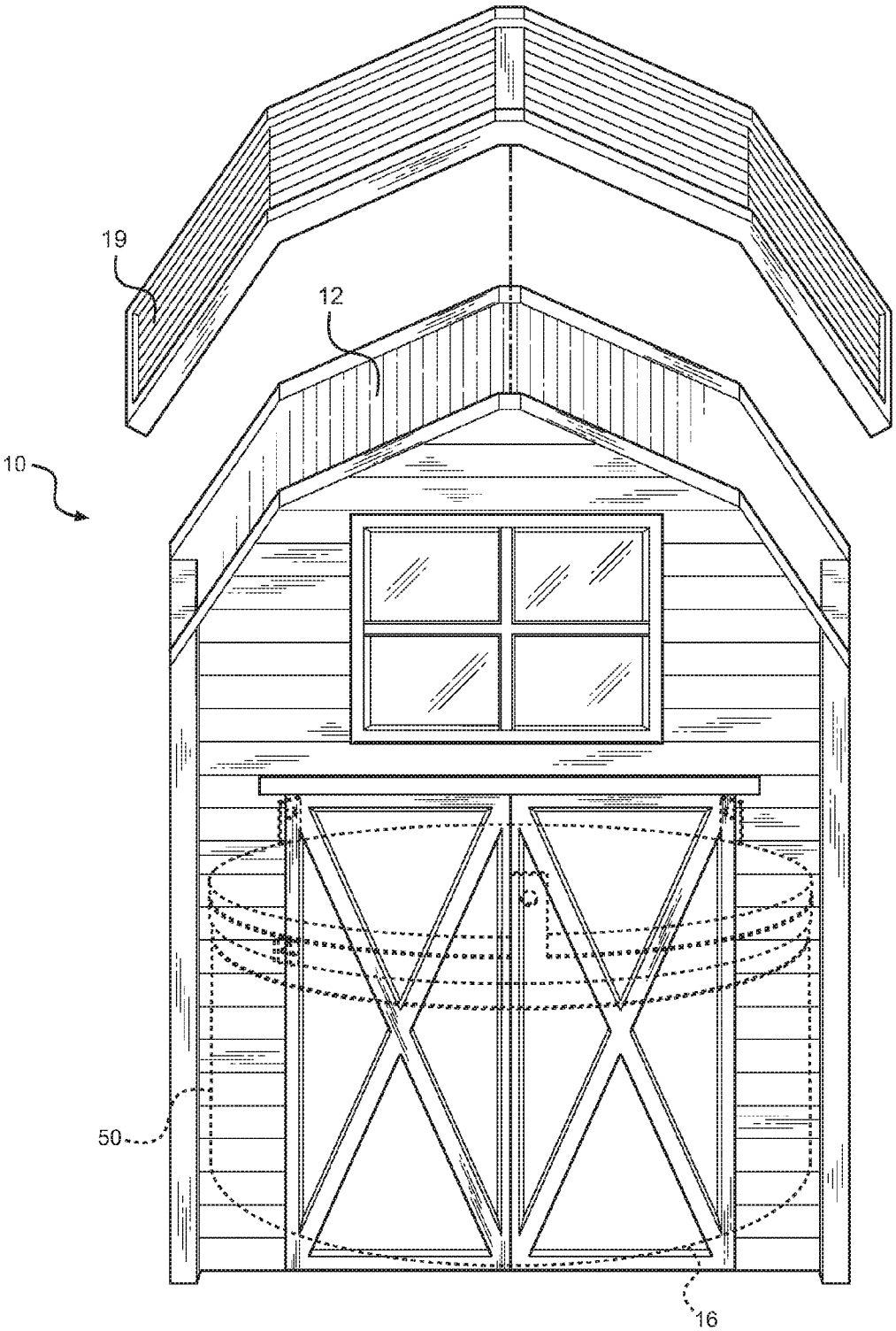
FIG. 5E shows yet another embodiment of the cover.

Along with a hollow interior 12, each of the covers includes a removable upper portion 19 to afford access to the perimeter ring and the lawn structure during and after the cover has been installed. The cover 19 includes an upper surface or a portion of the cover itself that is removable or hingeable from the upper end of the cover. As shown in FIG. 5A, the upper portion 19 comprises a section of the tree stump upper end, which is removable for access to the hollow interior 12. In FIG. 5D, the upper portion 19 of the silo is removable or hingeable for access to the hollow interior 12. In FIG. 5E, the upper portion 19 is the roof structure of the barn, which is removable from the barn to access the hollow interior 12.

The present invention is offered in many forms to provide a decorative and optionally functional lawn item. Functional covers include bird baths, flower planters, and other designs that incorporate utility beyond mere aesthetics or ornamentation. The cover is used for concealing man-made structures along a lawn or on a property that are permanently located thereon. The present invention therefore provides a benefit to home owners and business owners that have a desire and interest to improve the aesthetics of their outdoor spaces. At the same time, the removability of the cover and its fastened condition allows technicians to access the underlying structure when necessary by removing the fasteners connecting the cover thereto. Access to the fasteners and to the upstanding tabs of the ring is provided through a removable upper portion along the cover. It is not desired to limit the decorative outer design of the cover structure to those examples listed and shown herein, but rather to identify contemplated examples falling within the scope of the disclosed lawn structure cover invention.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A decorative lawn structure cover, comprising:

a cover having an outer surface, a lower surface, a hollow interior having an interior surface, and an open lower extending through the lower surface providing access to the hollow interior;

an elongated perimeter ring having one or more upstanding tabs that are adapted to support fasteners therethrough;

the elongated perimeter ring being adjustable in length such that the perimeter ring can be tensioned around a lawn structure;

the cover having a removable upper portion that provides access to the hollow interior;

the cover being adapted to receive fasteners into the interior surface of the hollow interior when the fasteners are positioned through the tabs of the perimeter ring when the ring has been placed over an upstanding lawn structure.

2. The decorative lawn structure cover of claim 1, wherein:

said elongated perimeter ring further comprises a first end and a second end, each end comprising an outwardly extending flange;

wherein the flanges are adapted to support a flange fastener therebetween;

said flange fastener configured to draw the flanges together to tension the elongated perimeter ring around the lawn structure when the perimeter ring is placed therearound.

3. The decorative lawn structure cover of claim 1, wherein said outer surface of said cover comprises a design of a well.

4. The decorative lawn structure cover of claim 1, wherein said outer surface of said cover comprises a design of a bird bath.

5. The decorative lawn structure cover of claim 1, wherein said outer surface of said cover comprises a design of a rock.

6. The decorative lawn structure cover of claim 1, wherein said outer surface of said cover comprises a design of a tree stump.

7. The decorative lawn structure cover of claim 1, wherein said outer surface of said cover comprises a design of a planter.

8. The decorative lawn structure cover of claim 1, wherein said outer surface of said cover comprises a design of a farm silo.

9. The decorative lawn structure cover of claim 1, wherein said outer surface of said cover comprises a design of a barn.

* * * * *